US010689189B1

(12) United States Patent
Rady et al.

(10) Patent No.: US 10,689,189 B1
(45) Date of Patent: Jun. 23, 2020

(54) EXTERNAL FLOATING ROOF TANK SHELL EXTENSION

(71) Applicant: PHILLIPS 66 COMPANY, Houston, TX (US)

(72) Inventors: Paul J. Rady, Katy, TX (US); Jeff McBride, Houston, TX (US)

(73) Assignee: PHILLIPS 66 COMPANY, Houston, TX (US)

( * ) Notice: Subject to any disclaimer, the term of this patent is extended or adjusted under 35 U.S.C. 154(b) by 84 days.

(21) Appl. No.: 16/209,245

(22) Filed: Dec. 4, 2018

(51) Int. Cl.
*B65D 88/42* (2006.01)
*B65D 90/38* (2006.01)

(52) U.S. Cl.
CPC ..... *B65D 88/42* (2013.01); *B65D 90/38* (2013.01)

(58) Field of Classification Search
CPC ..... B65D 88/34; B65D 90/38
See application file for complete search history.

(56) References Cited

U.S. PATENT DOCUMENTS 4,191,303 A * 3/1980 Kinghorn, Sr. ..... B65D 88/42 220/222
9,062,470 B2 * 6/2015 Mockry ..... E04H 5/12

* cited by examiner

*Primary Examiner* — Jason L Vaughan
*Assistant Examiner* — Amanda Kreiling
(74) *Attorney, Agent, or Firm* — Phillips 66 Company

(57) ABSTRACT

The invention relates to an inexpensive technique and procedure to add storage capacity to existing hydrocarbon storage tanks that have a double seal floating roof. The additional storage capacity is obtained by installing an extension that is strong enough to provide the upper seal of the double seal arrangement to maintain a sealed vapor space that allows the roof to move higher within the existing peripheral wall of the storage tank.

6 Claims, 3 Drawing Sheets

EXTERNAL FLOATING ROOF TANK SHELL EXTENSION

CROSS-REFERENCE TO RELATED APPLICATIONS

None.

STATEMENT REGARDING FEDERALLY SPONSORED RESEARCH OR DEVELOPMENT

None.

FIELD OF THE INVENTION

This invention relates to generally cylindrical liquid hydrocarbon storage tanks and more particularly to large capacity liquid hydrocarbon storage tanks for storing crude oil and hydrocarbon products used in refineries and in petrochemical and fuel transportation and distribution facilities.

BACKGROUND OF THE INVENTION

Generally cylindrical hydrocarbon storage tanks have been in use in refineries for many years. These tanks have been used to store and blend crude oils and intermediate hydrocarbon products for refining and also to store finished fuels for distribution. One of the safety advances for such storage tanks is the development of a floating roof. One of the concerns in storing hydrocarbons is that hydrocarbon vapors are, in many cases, flammable and, in some cases, have a toxicity concern. The floating roof development has reduced these concerns by reducing the volume of vapors in these large storage tanks.

Basically, a floating roof comprises a roof that is separate from the storage tank and floats on the liquid surface using flotation pontoons or other flotation arrangement. The roof then rises and falls with the volume of hydrocarbons. The vapor space is then limited to the volume between the liquid surface and the underside of the floating roof. To contain the vapors from the outside atmosphere two or more seals are positioned around the periphery of the floating roof to be in contact with the inside wall of the tank to seal the small vapor space from the outside atmosphere and prevent hydrocarbon releases. Typically, in such double seal arrangements, a primary seal is located just above the liquid level and a second seal is positioned above the primary seal by as much as four feet, but typically between about 18 inches and up to about 36 inches above the primary seal.

One of the drawbacks of such double seal arrangements is the limitation on the maximum capacity of the tank. Each of these large diameter storage tanks is essentially full when the second seal is just below the top of the wall. As such, as much as four feet vertical feet of capacity is unavailable. For a tank having a 100-foot diameter, adding four additional vertical feet of capacity translates to nearly 235,000 gallons of additional storage capacity not being available for liquid storage so as to provide vapor containment for the tank.

An alternative seal system that would reclaim the storage capacity or reduce the space committed to vapor containment could translate into significant dollars, especially for a storage terminal that is paid to store hydrocarbons. Additional storage capacity could translate into many dollars of added profit. This additional capacity would be a welcome addition if capacity could be incrementally increased without having to invest significantly in building additional tanks. This may be especially welcome when there is no available land to install new additional storage tanks.

BRIEF SUMMARY OF THE DISCLOSURE

The invention more particularly relates to a process for expanding the capacity of a floating roof cylindrical tank for storing hydrocarbons. The process includes starting with a cylindrical tank having a generally circular base with a periphery extending fully around the circular base and generally cylindrical peripheral wall extending vertically upward to a top edge and a floating roof with two spaced apart seals arranged for sealing contact against the generally cylindrical peripheral wall. A plurality of brackets are provided up to the top of the floating roof where the brackets include pre-drilled holes for attaching extension panels. A plurality of extension panels are provided that are each thinner and lighter weight than the generally cylindrical peripheral wall up to the top of the floating roof where the extension panels include pre-drilled holes to attach to the brackets and to attach each panel to others of the plurality of panels. A sealant is provided between each bracket and the generally cylindrical peripheral wall and attaching each bracket to the generally cylindrical wall end to end so as to create a sealed connection between the brackets and the generally peripheral wall and to provide a structure for which the extension panels may be attached to the generally cylindrical peripheral wall. A sealant is provided between each of the panels and the bracket and attaching each of the panels to the bracket and to one another in an overlapping arrangement where the panels overlap at least part of the bracket and where at least part of each panel overlaps with other panels with sealant between where they overlap such that when the panels are attached to the brackets they form a generally cylindrical wall extension extending upwardly from the generally cylindrical wall such that the upper of the two seals on the floating roof may move vertically with the floating roof and maintain a sealed vapor space as the seal passes above the top edge of the generally cylindrical peripheral wall and into contact with the panel extensions sealed together and to the generally cylindrical peripheral wall.

BRIEF DESCRIPTION OF THE DRAWINGS

A more complete understanding of the present invention and benefits thereof may be acquired by referring to the follow description taken in conjunction with the accompanying drawings in which.

DETAILED DESCRIPTION

Turning now to the detailed description of the preferred arrangement or arrangements of the present invention, it should be understood that the inventive features and concepts may be manifested in other arrangements and that the scope of the invention is not limited to the embodiments described or illustrated. The scope of the invention is intended only to be limited by the scope of the claims that follow.

Figure 1:
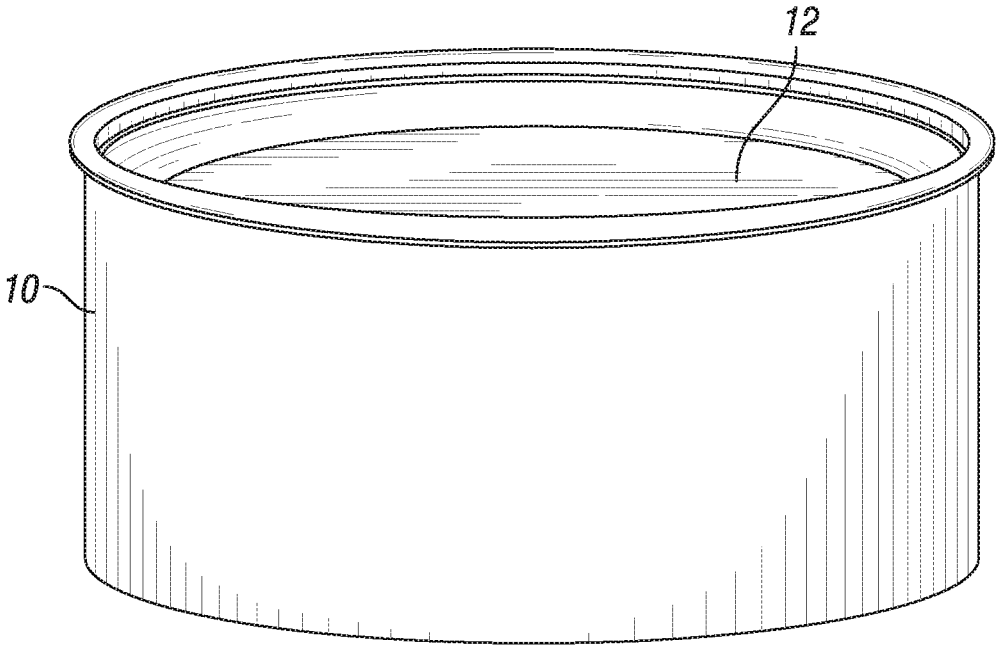
FIG. 1 (Prior Art)
FIG. 1 is a perspective view of a conventional hydrocarbon storage tank with a floating top.
Figure 2:
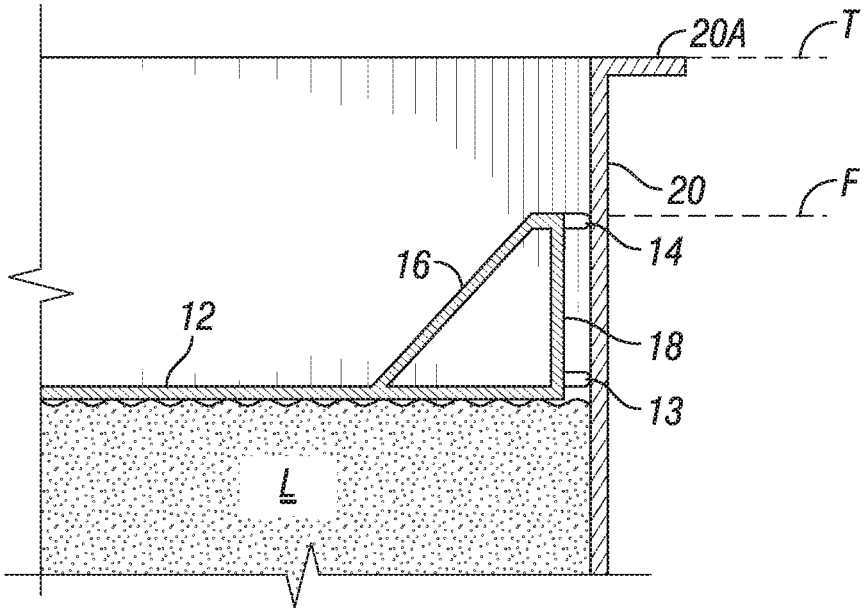
FIG. 2 (Prior Art)
FIG. 2 is a fragmentary cross section elevation view of the seal of the floating top of a hydrocarbon storage tank shown with the conventional arrangement with two vertically spaced apart seals positioned against the interior peripheral wall of the storage tank.

As shown in FIGS. 1 and 2, a conventional hydrocarbon storage tank is generally indicated by the number 10 having a generally circular base, a cylindrical peripheral wall 20 extending up from the base and having a top comprising a floating roof 12. The cylindrical peripheral wall 20 is typically made of steel and is fabricated to hold a very high volume of liquid hydrocarbons L such as crude oil, gasoline, diesel, naphtha and a host of other intermediate and finished hydrocarbon liquids. While such tanks may be made in just about any dimension, it is typical for such storage tanks to be large with a diameter in the range of 100-foot diameter and in excess of 30 feet tall or deep.

The floating roof 12 is arranged to float on the surface of the liquid contents of the tank 10 using flotation pontoons or the like while raising and lowering as the liquid level changes. The reason to have a floating roof 12 is to minimize the vapor space between the surface level and the bottom of the floating roof 12. Vapors are hazardous, so minimizing the volume of vapor with in a hydrocarbon storage tank is safer, preferred and typically required by environmental regulations.

Focusing on FIG. 2, the floating roof 12 includes a sealing system engaged with the cylindrical peripheral wall 20. The sealing system includes two spaced apart seals where a primary seal 13 is positioned at the peripheral edge of the floating roof 12 to engage the peripheral wall 20. A second seal 14 is positioned 18 or more inches above the primary seal 13 although it is more conventional that these two seals 13 and 14 are spaced apart by two to three feet and as much as four feet apart. The second seal 14 is oriented like the main seal to engage against the inside surface of the peripheral wall 20 vertically above the primary seal 13 and move vertically within the cylindrical wall 20. The two seals 13 and 14 seal the vapor space from the open atmosphere preventing hydrocarbon emissions and together to contain the hydrocarbons. The primary seal 13 and the second seal 14 are made of flexible material, typically of a hydrocarbon resistant rubber so that they slide along and seal against the inside of the cylindrical wall 20 flexing to follow the contour of the cylindrical wall 20 and accommodate any reasonable shifting of the floating roof due to unequally distributed weight from workers or equipment on the floating roof 12. The roof typically has a shape such as with sloping roof segment 16 to maintain outward pressure of the second seal 14 against the wall 20

FIGS. 1 and 2 show the conventional floating roof technology for liquid hydrocarbon storage tanks in use around the world. The invention relates to an improvement to such hydrocarbon storage tanks that simply and very inexpensively increases that available storage capacity of an existing tank by about the vertical spacing between the primary seal 13 and the second seal 14. The point that was observed by the inventors is that both seals need to engage the peripheral wall making the highest permissible liquid level be indicated by the dotted line F in FIG. 2 even though the top of the peripheral wall is indicated by the dotted line T. The difference between dotted line T and dotted line F represents a significant difference in capacity within the tank. But, the upper portion of the cylindrical wall 20, where only the second seal 14 ever impinges, does not have to be as structurally strong as the rest of the cylindrical wall 20. The weight of the liquid is never imposed on that upper portion between the full level L and the top T. While the dimension and strength of the cylindrical wall of an existing storage tank is strong top to bottom, it is sufficiently strong to hold the weight of the liquid right to the top T of the tank 10. For example, the wall 20 of storage tank 10 is typically at least ¼ inch thick carbon steel at its top and often thicker and certainly thicker at lower course heights of storage tanks. Being strong enough to hold liquid, all that is needed is an extension that can provide a vapor seal for second seal 14 to engage.

Figure 3:
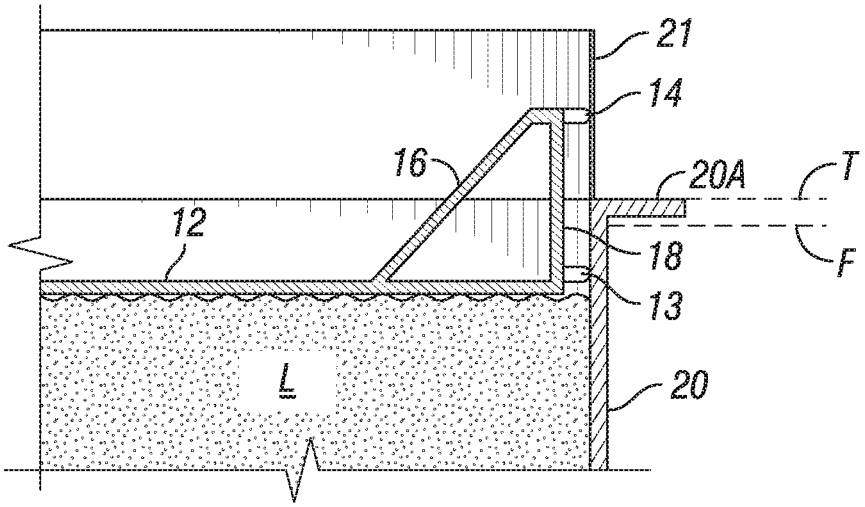
FIG. 3 is a fragmentary elevation view similar to FIG. 2, but showing a simple and inexpensive extension modification to the tank according to the present invention that allows the floating top to rise higher in the tank while containing the liquid hydrocarbons inside the tank with the spaced apart double seal for vapor containment.

Turning now to FIG. 3, with an inexpensive extension 21 projecting upwardly from the top of the peripheral wall 20, the full liquid level or highest permissible level F is much closer to the top T of the peripheral wall 20 as shown by the new full level F just below the top T of the tank 10. This creates additional volume capacity that is roughly equal to the spacing between the two seals 13 and 14 taking into consideration the area under the roof 12. This represents a significant gain in storage capacity. For example, in a storage tank have the spacing between the primary seal 13 and the second seal 14 of 2 feet with tank diameter of 100 feet, the volume that can be gained by allowing the liquid level to approach the true top of the tank T would create more than 117,000 gallons of additional capacity. For a facility that does not own hydrocarbons, but only charges others for storage of their hydrocarbons, this additional capacity gained in one storage tank can represent a significant financial opportunity. Once the cost of installing the extension has been incurred, there is essentially no further cost for storing additional hydrocarbons and therefore charging additional storage fees.

Figure 4:
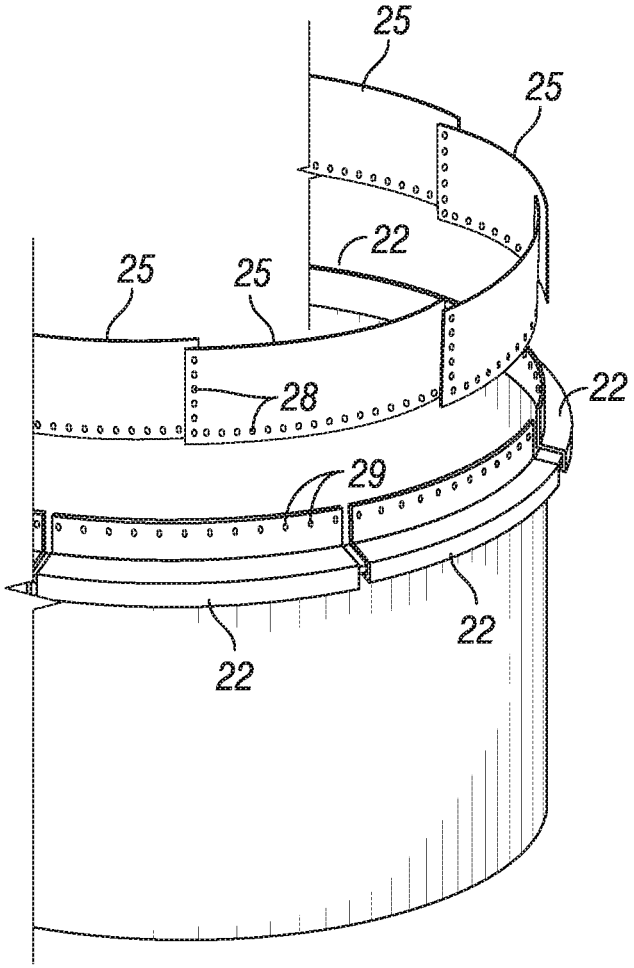
FIG. 4 is an exploded fragmentary perspective view of a hydrocarbon storage tank showing the extension for creating added storage capacity in a form for being assembled and installed to an existing hydrocarbon storage tank while in service.
Figure 5:
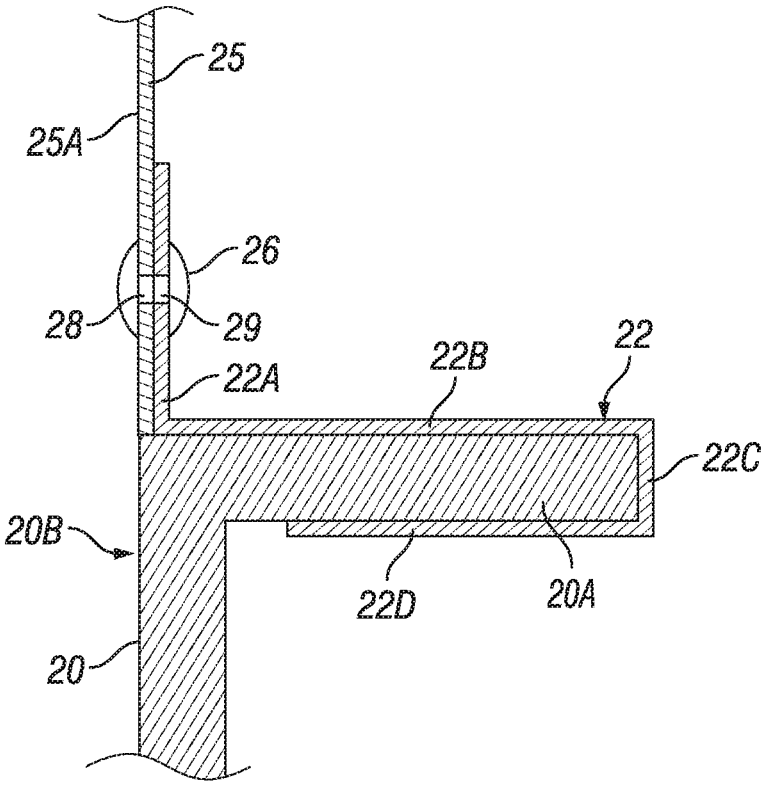
FIG. 5 is an enlarged fragmentary cross-sectional view showing a preferred arrangement for adding a seal extension according to the present invention.

Focusing now on the inventive lightweight extension 21 as shown in FIGS. 3, 4 and 5 and as envisioned the inventors, the second seal 14 is allowed to float above the top of the peripheral wall 20 but still keep the vapors inside the storage tank 10 separated from the atmosphere. The second seal 14 would continue to function quite satisfactorily while moving vertically up and down along the light weight sealing extension 21. The extension 21 extends vertically to a level above the top T of the storage tank 10 to a height preferably at least the distance between the two seals 13 and 14. The extension is preferably made of stainless steel and is preferably a thin gauge of between 0.010 inches up to ⅛ inch but would more preferably be between 0.020 and 0.050 inches thick. Alternatively, the extension 21 may be plastic, aluminum or other lightweight metal. The extension 21 would not need to be permanent, but once installed, it is unlikely to be removed except for maintenance or repairs.

Focusing now on an example installation for a lightweight extension that does not include welding or drilling on the existing storage tank that is in service (with hydrocarbons stored in the tank while the extension is being installed). A preferred attachment method is shown in FIGS. 4 and 5 where the extension includes a plurality of thin panels 25 that are arc shaped comparable to the radius of the circular arc of the peripheral wall 20 of the storage tank 10. Each of the panels includes pre-drilled holes 27 vertically along each end which, when aligned allows the panels 25 to overlap with one another. The overlapping ends are arranged to be bolted together or, more preferably, to be riveted together. An elastomeric sealant is applied between the sections 25 where they overlap to create an effectively continuous circumferential extension at the top of the peripheral wall 20. The panels 25 also have a horizontal row of pre-drilled holes 28 along the lower portion so that they may be mounted to the top of the peripheral wall 20 by a series of spring brackets 22. The horizontally arranged pre-drilled holes 28 are arranged to align with pre-drilled holes 29 in spring brackets 22. More specifically, as shown in FIG. 5, the spring brackets 22 include a vertical segment 22A against which the panels 25 may be attached using rivets 26 through horizontal pre-drilled holes 28 and 29. The spring brackets 22 include a shape to attach to and extending around flange 20A at the top of the peripheral wall 20 of the existing storage tank 10. This flange 20A is conventional at the top of the peripheral wall 20 where it extends outwardly to strengthen or reinforce the main body of the peripheral wall 20. The flange 20A is sufficiently strong to support a modest (4 vertical feet upwardly is not excessive) lightweight extension comprised of panels 25. The spring brackets 22 are preferably formed of bent sheet steel to form a channel that slips over the flange 20A with a compression grip on both top and bottom of the flange 20A.

The attachment of the spring bracket 22 is best shown in FIG. 5 where it can be seen that the vertical segment 22A extends vertically from the top of the peripheral wall 20 of the storage tank 10. The vertical segment 22A extends from a top horizontal segment 22B formed as a bend in a common sheet of thin stainless steel. The top horizontal segment 22B lies flush on top of the top surface of the flange 20A while an end segment 22C extends around the outer periphery of the flange 20A and holds a bottom horizontal segment generally flush against the bottom of the flange 20A. The bends formed in the thin sheet of stainless steel are preferably exaggerated so that the top horizontal segment 22B and bottom horizontal segment 22D squeeze against the flange 20A. The panels 25 are attached in an overlapping manner with the vertical segment 22A such that the inside face 25A of the panel 25 is nearly flush with the inside face 20B of the peripheral wall 20 and so that the second seal 14 may slide from the inside face 20B up to the inside face 25A of the extension 21 without breaking sealing contact and maintaining the vapor space closed from the outside environment.

While the spring brackets are preferably attached end to end to extend fully around the peripheral wall 20, preferably they do not overlap each other as some small space may be left between the ends for adjustments during the installation process. These small gaps are preferably bridged by a panel 25 to minimize potential leaks such that the joints of the panels 25 are offset relative to the joints in the spring brackets 22. Sealing materials, such as an elastomeric, paste or putty, is preferably applied with the panels 25 attach flush to the vertical segments 22A.

In a manner similar to the attachment of the panels 25 end to end, sealing compound such as elastomeric sealer is preferably applied before the spring bracket is slipped on to the flange 20A. The spring bracket includes a vertical segment extending upwardly to the top of the channel section with a series of pre-formed holes for attachment of the panels that also have the pre-formed holes. Elastomeric sealer is also applied to the overlap of the vertical section with the panels.

The process of installing the extension 21 begins by providing spring brackets and extension sections 25 up to the top of the floating roof. The sections 25 and spring brackets 22 are preferably light enough to be carried up the stairs by human personnel and not require heavy lifting equipment, like a crane or construction forklift, to lift the sections to the top of the tank 10. Sealing compound is applied to the top of the flange 20A and then spring brackets 22 are slipped over the flange 20A one by one in an end-to-end arrangement extending fully around the periphery of the storage tank 10 with the respective vertical segments 22A of each of the spring brackets 22 being positioned in near alignment with the inner face 20B of the peripheral wall 20. With the spring brackets 22 attached, the panels 25 are then attached to the vertical segments with sealing compound added between each flat overlying face of the panels 25 and vertical segments 22A until the extension 21 is fully complete around the peripheral wall 20. After passing inspections, the liquid level in the storage tank 10 may be raised such that floating roof 12 may float higher within the peripheral wall 20 while lifting the second seal 14 above the top T of the peripheral wall 20 and into contact with the extension 21.

In closing, it should be noted that the discussion of any reference is not an admission that it is prior art to the present invention, especially any reference that may have a publication date after the priority date of this application. At the same time, each and every claim below is hereby incorporated into this detailed description or specification as additional embodiments of the present invention.

Although the systems and processes described herein have been described in detail, it should be understood that various changes, substitutions, and alterations can be made without departing from the spirit and scope of the invention as defined by the following claims. Those skilled in the art may be able to study the preferred embodiments and identify other ways to practice the invention that are not exactly as described herein. It is the intent of the inventors that variations and equivalents of the invention are within the scope of the claims while the description, abstract and drawings are not to be used to limit the scope of the invention. The invention is specifically intended to be as broad as the claims below and their equivalents.

The invention claimed is:

1. A process for expanding the capacity of a floating roof cylindrical tank for storing hydrocarbons comprising:

providing a cylindrical tank with a generally circular base having a periphery extending fully around the circular base and generally cylindrical peripheral wall extending vertically upward to a top edge and a floating roof with two spaced apart seals arranged for sealing contact against the generally cylindrical peripheral wall;

providing a plurality of brackets up to the top of the floating roof where the brackets include pre-drilled holes for attaching extension panels;

providing a plurality of extension panels that are each thinner and lighter weight than the generally cylindrical peripheral wall up to the top of the floating roof where the extension panels include pre-drilled holes to attach to the brackets and to attach each panel to others of the plurality of panels;

providing a sealant between each bracket and the generally cylindrical peripheral wall and attaching each bracket to the generally cylindrical wall end to end so as to create a sealed connection between the brackets and the generally peripheral wall and to provide a structure for which the extension panels may be attached to the generally cylindrical peripheral wall;

providing a sealant between each of the panels and the bracket and attaching each of the panels to the bracket and to one another in an overlapping arrangement where the panels overlap at least part of the bracket and where at least part of each panel overlaps with other panels with sealant between where they overlap such that when the panels are attached to the brackets they form a generally cylindrical wall extension extending upwardly from the generally cylindrical wall such that the upper of the two seals on the floating roof may move vertically with the floating roof and maintain a sealed vapor space as the seal passes above the top edge of the generally cylindrical peripheral wall and into contact with the panel extensions sealed together and to the generally cylindrical peripheral wall.

2. The process according to claim 1 wherein the top edge includes an outwardly extending flange and the bracket is secured to the outwardly extending flange.

3. The process according to claim 1 wherein the panels connect to one another at overlapping joints and each bracket butts up against brackets at each edge at butt joints such that the process includes attaching the panels together such that the overlapping joints are offset relative to the butt joints so that two such joints do not coincide to weaken the seal of the floating roof storage tank.

4. The process according to claim 1 wherein the panels are attached to one another by rivets.

5. The process according to claim 1 where the brackets and panels are installed while hydrocarbons are stored in the floating roof storage tank and no drilling or welding would be allowed to occur that would be hazardous with hydrocarbons in such proximity to the installation of the panel extension.

6. The process according to claim 1 where the peripheral wall has a thickness and the panel extensions has a thickness and wherein the step of providing the panel extensions includes selecting panel extensions that are less than on fifth of the peripheral wall thickness.

* * * * *